US009404713B2

(12) United States Patent
Piazza et al.

(10) Patent No.: US 9,404,713 B2
(45) Date of Patent: Aug. 2, 2016

(54) GUN SIGHT FOR USE WITH SUPERELEVATING WEAPON

(71) Applicant: General Dynamics Ordnance and Tactical Systems, Inc., Saint Petersburg, FL (US)

(72) Inventors: Jonathan Piazza, Burlington, VT (US); Theodore Bloomhardt, Hinesburg, VT (US); John Fletcher, III, Richmond, VT (US); Vladimir G. Krylov, Brookline, NH (US); Craig Pepper, Shelburne, VT (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 103 days.

(21) Appl. No.: 14/206,580

(22) Filed: Mar. 12, 2014

(65) Prior Publication Data

US 2015/0253112 A1 Sep. 10, 2015

Related U.S. Application Data

(60) Provisional application No. 61/793,808, filed on Mar. 15, 2013.

(51) Int. Cl.

| | |
|---|---|
| ***F41G 5/06*** | (2006.01) |
| ***F41G 11/00*** | (2006.01) |
| ***F41G 3/06*** | (2006.01) |
| ***F41G 3/16*** | (2006.01) |
| ***H04N 5/232*** | (2006.01) |

(52) U.S. Cl.

CPC *F41G 11/00* (2013.01); *F41G 3/06* (2013.01); *F41G 3/165* (2013.01); *H04N 5/23293* (2013.01)

(58) Field of Classification Search

USPC ..... 89/41.05, 41.06, 41.07, 41.19; 235/404

See application file for complete search history.

(56) References Cited

U.S. PATENT DOCUMENTS

| | | | |
|---|---|---|---|
| 2,538,821 | A | 1/1951 | Wheeler |
| 4,760,770 | A | 8/1988 | Bagnall-Wild et al. |
| 4,876,942 | A | 10/1989 | Nilsson |
| 5,171,933 | A | 12/1992 | Eldering |
| 5,456,157 | A | 10/1995 | Lougheed et al. |
| 5,686,690 | A | 11/1997 | Lougheed |

(Continued)

OTHER PUBLICATIONS

USPTO, Response to Office Action for U.S. Appl. No. 13/688,779, mailed Jun. 2, 2014.

(Continued)

*Primary Examiner* — J. Woodrow Eldred

(74) *Attorney, Agent, or Firm* — Ingrassia, Fisher & Lorenz PC

(57) ABSTRACT

A gun sight for use with a weapon configured for super elevation is disclosed herein. The gun sight includes, but is not limited to, an imaging system that is configured for rotation. The gun sight further includes a drive mechanism that associated with the imaging system and that is configured to rotate the imaging system. The gun sight further includes a gyroscope associated with one of the weapon and the imaging system. The gun sight still further includes a processor that is communicatively coupled with the drive mechanism and the gyroscope. The processor is configured to control the drive mechanism to rotate the imaging system in a manner that causes the imaging system to maintain an initial angular orientation based on information provided by the gyroscope when the weapon is superelevated.

20 Claims, 6 Drawing Sheets

(56) References Cited

U.S. PATENT DOCUMENTS

| | | | |
|---|---|---|---|
| 6,349,477 | B1 | 2/2002 | Hunter |
| 6,499,382 | B1 | 12/2002 | Lougheed et al. |
| 7,698,986 | B2 | 4/2010 | Persson et al. |
| 7,946,212 | B1 | 5/2011 | Quinn |
| 2004/0009798 | A1 | 1/2004 | Okuda et al. |
| 2008/0107414 | A1 | 5/2008 | Showalter |
| 2009/0040308 | A1 | 2/2009 | Temovskiy |
| 2009/0139393 | A1 | 6/2009 | Quinn |
| 2010/0275768 | A1 | 11/2010 | Quinn |
| 2011/0181722 | A1 | 7/2011 | Gnesda et al. |
| 2011/0288804 | A1 | 11/2011 | Lee et al. |
| 2012/0159833 | A1 | 6/2012 | Hakanson et al. |
| 2013/0133510 | A1 | 5/2013 | Piazza et al. |

OTHER PUBLICATIONS

USPTO, Office Action for U.S. Appl. No. 13/688,946, mailed Jun. 18, 2014.

The International Bureau of WIPO, International Preliminary Report on Patentability for International Application No. PCT/US2012/067084, mailed Jun. 12, 2014.

The International Bureau of WIPO, International Preliminary Report on Patentability for International Application No. PCT/US2012/067088, mailed Jun. 12, 2014.

USPTO, Notice of Allowance and Fee(s) Due for U.S. Appl. No. 13/688,946, mailed Jan. 22, 2015.

USPTO, Response to Office Action for U.S. Appl. No. 13/688,946, mailed Sep. 25, 2014.

PCT International Search Report and Written Opinion mailed Aug. 8, 2013 in PCT/US12/67084.

PCT International Search Report and Written Opinion mailed Aug. 8, 2013 in PCT/US12/67088.

USPTO, Non-Final Office Action for U.S. Appl. No. 13/688,779, mailed Feb. 7, 2014.

United States International Searching Authority, International Search Report and Written Opinion for International Application No. PCT/US 14/25238, mailed Nov. 18, 2014.

USPTO, Notice of Allowance and Fee(s) Due for U.S. Appl. No. 13/688,779 mailed Feb. 13, 2015.

USPTO, Response to Office Action for U.S. Appl. No. 13/688,779 mailed Dec. 29, 2014.

USPTO, Office Action for U.S. Appl. No. 13/688,779, mailed Sep. 30, 2014.

Hungarian Intellectual Property Office, Search Report for Singapore Patent Application No. 11201506547V dated Nov. 23, 2015.

Hungarian Intellectual Property Office, Written Opinion for Singapore Patent Application No. 11201506547V dated Nov. 23, 2015.

The International Bureau of WIPO, International Preliminary Report on Patentability for International Application No. PCT/US2014/025238 mailed Sep. 24, 2015.

GUN SIGHT FOR USE WITH SUPERELEVATING WEAPON

CROSS-REFERENCE TO RELATED APPLICATION

This application claims the benefit of U.S. Provisional Patent Application 61/793,808 filed 15 Mar. 2013 and entitled "Gun Sight For Use With Superelevating Weapon", which is hereby incorporated herein by reference in its entirety.

TECHNICAL FIELD

The present invention generally relates to weapons and more particularly to a gun sight for use with a weapon configured for superelevation.

BACKGROUND

For some weapons, such as grenade launching machine guns which fire relatively slow rounds, it is necessary to elevate the weapon by a significant angle above the line of sight to the target (e.g., by an angle greater than half the field of view of the gun sight) in order to reach the target with the grenade round. Such weapons are often used in conjunction with a gun sight that is coupled with a display that presents an image of a down range area that includes the target. An aiming reticle is often displayed on the display, the position of which is calculated by a ballistic algorithm, to assist the operator in aiming the weapon and engaging a target down range.

Modern gun sights have high levels of magnification that permit precise aiming of the weapon at long ranges. Such gun sights provide a field of view of only a few degrees. When a targeting solution is determined that requires superelevation, the gun sight may be elevated together with the weapon and the target will very likely move off of the display when the required superelevation exceeds the field of view. This loss of visual contact with the target during superelevation is undesirable.

One solution to this problem was described in U.S. Pat. No. 6,499,382 issued to Lougheed et al. Lougheed describes a grenade machine gun or other weapon that employs superelevation of the barrel and an aiming system. The aiming system is mounted to both the weapon and the weapon's support or base. The aiming system is configured to alternatively lock to either the weapon or to the weapon's support. When locked to the weapon, the aiming system is free to rotate in elevation and azimuth in unison with the weapon. When locked to the weapon support, the aiming system is restrained from elevation and thus the weapon can be superelevated while the aiming system remains oriented at a static elevation angle. In this manner, the weapon can be superelevated yet still allow an operator to maintain visual contact with the target on the display.

While this solution is adequate, there is room for improvement. For example, Lougheed's aiming system is large and has substantial mass. Additionally, systems constructed in accordance with Lougheed's disclosure have historically been very expensive. Also, in some circumstances, it may not be sufficient or desirable to lock the aiming system into a static elevation angle with respect to the weapon support. For example, the terrain may be sandy or muddy or otherwise unstable. On such terrain, superelevation of the weapon or other circumstances may cause the weapon support to shift. This, in turn, would cause an unintended deviation of the aiming system and possibly a loss of line of sight to the target. Furthermore, by having the gun sight attach to the weapon mount, the gun sight is less adaptable for use with different weapons. A less massive, less expensive gun sight that is not statically locked to the weapon's base during superelevation and that provides greater adaptability for use with multiple weapons is desired. Furthermore, other desirable features and characteristics of the present disclosure will become apparent from the subsequent detailed description and the appended claims, taken in conjunction with the accompanying drawings and the foregoing technical field and background.

BRIEF SUMMARY

A gun sight is disclosed herein for use with a weapon configured for superelevation. The weapon may include an angle measuring device configured to measure both an angular orientation of the weapon and a change in an angular orientation of the weapon.

In a first, non-limiting embodiment the gun sight includes, but is not limited to, an imaging system configured for rotation in elevation. The gun sight further includes, but is not limited to, a drive mechanism associated with the imaging system and configured to rotate the imaging system. The gun sight further includes, but is not limited to, a gyroscope associated with one of the weapon and the imaging system. The gun sight still further includes, but is not limited to, a processor communicatively coupled with the drive mechanism and the gyroscope and configured to control the drive mechanism to rotate the imaging system in a manner that causes the imaging system to maintain an initial angular orientation based, at least in part, on information provided by the gyroscope when the weapon is superelevated.

In another, non-limiting embodiment, the gun sight includes, but is not limited to an imaging system adapted to be operatively coupled to a display unit having a display. The imaging system is configured to control the display unit to display an image of an object detected by the imaging system. The imaging system is further configured for rotation in elevation. The gun sight further includes, but is not limited to, a gyroscope associated with the imaging system and configured to detect both an angular orientation of the imaging system and a change in the angular orientation of the imaging system. The gun sight further includes, but is not limited to, a drive mechanism associated with the imaging system and configured to rotate the imaging system. The gun sight still further includes a processor communicatively coupled with the drive mechanism and the gyroscope. The processor is configured to control the drive mechanism to rotate the imaging system in a manner that causes the imaging system to maintain an initial angular orientation based, at least in part, on information provided by the gyroscope when the gyroscope detects the change in the angular orientation of the imaging system during superelevation of the weapon.

In another, non-limiting embodiment, the gun sight includes, but is not limited to, an imaging system adapted to be operatively coupled to a display unit having a display. The imaging system is configured to control the display unit to display an image of an object detected by the imaging system. The imaging system is further configured for rotation in elevation. The gun sight further includes, but is not limited to, a gyroscope adapted for mounting to the weapon and configured to detect the current angular orientation of the weapon. The gun sight further includes, but is not limited to, a drive mechanism associated with the imaging system and configured to rotate the imaging system. The gun sight still further includes, but is not limited to, a processor communicatively coupled with the drive mechanism and the gyroscope and adapted for communicative coupling with the angle measuring device. The processor is configured to obtain the current angular orientation of the weapon during superelevation from the gyroscope and to obtain the change in the angular orientation of the weapon during superelevation from the angle measuring device. The processor is further configured to control the drive mechanism to rotate the imaging system in a manner that maintains a desired angular orientation of the imaging system based, at least in part, on information provided by the gyroscope when the gyroscope detects a change in angular orientation of the weapon while the weapon is superelevated.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
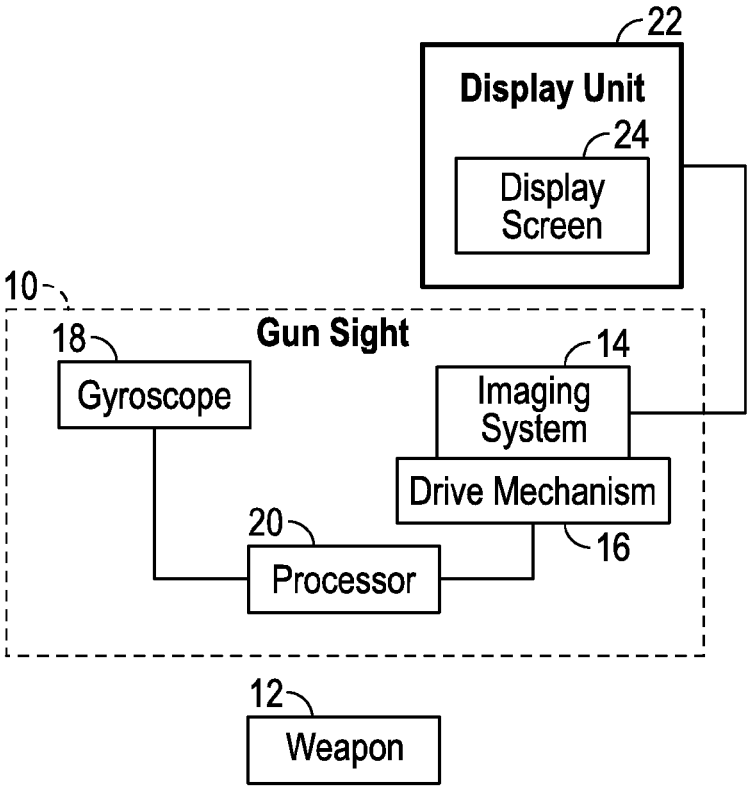
FIG. 1 is a block diagrammatic view illustrating a gun sight made in accordance with the teachings of the present disclosure.

The following detailed description is merely exemplary in nature and is not intended to limit the invention or the application and uses of the invention. Furthermore, there is no intention to be bound by any theory presented in the preceding background or the following detailed description.

An improved gun sight is disclosed herein that is configured to maintain a line of sight to the target during superelevation of the weapon. The gun sight, or a portion of the gun sight, is configured to rotate with respect to the weapon. The gun sight utilizes a processor, a gyroscope, and a drive mechanism to steady itself at an elevation that aligns the gun sight with a line of sight to a target. The gun sight is mounted to the weapon and will rotate together with the weapon in azimuth and will further rotate together with the weapon elevation during non-superelevating changes in elevation of the weapon. When superelevation is initiated, the processor will use information that is provided by the gyroscope to operate the drive mechanism to rotate the gun sight, or a portion of the gun sight, in a manner that offsets the rotation of the superelevating weapon, thereby allowing the gun sight to maintain a line of sight to the target.

In one embodiment, the gyroscope may be mounted to the gun sight. When superelevation is initiated, the gun sight will detect its initial angular orientation and the processor will obtain the initial angular orientation from the gyroscope. As the weapon is superelevated, the gyroscope will detect a deviation of the gun sight from the initial angular orientation. When the processor receives information from the gyroscope indicative of the deviation of the gun sight from the initial angular orientation, the processor will instruct the drive mechanism to rotate the gun sight, or a portion of the gun sight, in a manner that offsets the deviation and that maintains the gun sight at the initial angular orientation and, as a result, directs the gun sight's line of sight to the target.

In another embodiment, the gyroscope may be mounted to the weapon and will detect the angular orientation of the weapon. The weapon will include an additional angle measuring device that is used to provide elevation information to the weapon's fire control system for use in calculating a firing solution. In some embodiments, the additional angle measuring device will measure the angle between the weapon and the gun sight's line of sight (i.e., the superelevation angle). As the weapon is superelevated, changes in the angular orientation of the weapon will be detected by the gyroscope. Changes in the elevation of the weapon will be measured by the angle measuring device. The gyroscope and the angle measuring device will provide information to the processor that indicates that a deviation in the angular orientation of the weapon has occurred and the amount of such deviation. The processor will use this information to control the drive mechanism to rotate the gun sight, or a portion thereof, in a manner that maintains the gun sight at a desired angular orientation that provides the gun sight with a line of sight to the target.

A greater understanding of the embodiments of the gun sight disclosed herein may be obtained through a review of the illustrations accompanying this application together with a review of the detailed description that follows.

FIG. 1 is a block diagram illustrating a non-limiting embodiment of a gun sight 10, made in accordance with the teachings of the present disclosure. Gun sight 10 may be adapted for mounting to weapon 12 such that gun sight 10 rotates in azimuth together with weapon 12 and also rotates in elevation together with weapon 12 at times other than when weapon 12 is being superelevated. By locking the rotation of gun sight 10 to that of weapon 12, the operator is able to both rotate and elevate weapon 12 while looking through a view finder displaying images captured by gun sight 10, allowing the operator to identify and select targets downrange. In some embodiments, weapon 12 and gun sight 10 may be bore sighted such that weapon 12 and gun sight 10 remain optically locked together in an aligned position, such that the weapon and the gun sight remain pointing at a single down range location. Weapon 12 may be any weapon that utilizes superelevation including, but not limited to mortar launchers, grenade launchers, machine grenade launchers, artillery, rifles, machine guns, and the like.

Gun sight 10 includes an imaging system 14, a drive mechanism 16, a gyroscope 18, and a processor 20. In other embodiments, gun sight 10 may include a greater number of components without departing from the teachings of the present disclosure. In some embodiments, each of the components of gun sight 10 may be enclosed in a single housing, while in other embodiments, only some of the components may be contained within a housing. In still other embodiments, each of the components may be housed separately. In some embodiments, the components of gun sight 10 may be used exclusively by gun sight 10 while in other embodiments, one or more components may be shared with weapon 12 or some other device.

Imaging system 14 may comprise any suitable imaging system including, without limitation, a daytime imaging system (e.g., a video camera, television camera), a thermal imaging system, an infrared imaging system, a laser range finder, a radar system, a sonar system, or any other type of system that is configured to perceive and/or detect the presence of an object at a downrange location. In some embodiments, imaging system 14 may include only one type of imaging system while in other embodiments, imaging system 14 may include two or more types of imaging system. By including multiple types of imaging systems, an operator is provided with the flexibility that may be needed to accommodate different or changing battlefield conditions such as nightfall and inclement weather.

Imaging system 14 is configured to rotate in elevation with respect to weapon 12. Such configuration may be accomplished in any suitable manner. In some embodiments, imaging system 14 may be directly configured to rotate, such as through the use of a central axis extending through imaging system 14 and/or through rolling engagement between an outer surface of imaging system 14 and an external supporting surface. In other embodiments, imaging system 14 may be mounted to a carrier or drum that is configured to rotate with respect to weapon 12. In still other embodiments, imaging system 14 may be contained within a housing and the housing may be configured to rotate with respect to weapon 12. In still other embodiments, imaging system 14 may be contained within a housing that remains stationary with respect to weapon 12 and is configured to rotate with respect to the housing. Any other suitable configuration that permits imaging system 14 to rotate in elevation with respect to weapon 12 may also be employed.

Imaging system 14 is configured to be operatively coupled with, and to control, a display unit 22. Display unit 22 includes a display 24 that may be configured to utilize any display technology capable of displaying graphic images. Imaging system 14 is configured to control display unit 22 to display images on display 24 of objects detected by imaging system 14. In this manner, potential targets located down range of gun sight 10 may be presented visually to an operator of weapon 12. Weapon 12 may include a fire control system that may also be operatively coupled with display unit 22 and that is configured to calculate a firing solution based on the position of weapon 12. In cases where superelevation of weapon 12 is necessary, the firing solution will require a change in the elevation angle of weapon 12. The need to change the elevation angle of weapon 12 may be communicated to an operator by movement or relocation of one or more reticles on the display. When combined with the images presented by imaging system 14, the reticles allow an operator to target specific objects down range of weapon 12 and the repositioning of one or more of the reticles on display 24 by the fire control system of weapon 12 may signal to the operator that superelevation is needed.

Drive mechanism 16 is associated with imaging system 14. Drive mechanism 16 may comprise any suitable type of drive mechanism including, but not limited to, a servo motor; gear train; feedback device including, but not limited to, an angle encoder. Drive mechanism 16 may be mounted to imaging system 14 or to another structure proximate to imaging system 14. Drive mechanism 16 is configured, mounted, and/or arranged so as to cause imaging system 14 to rotate when drive mechanism 16 is actuated. In some embodiments, drive mechanism 16 may be configured to cause imaging system 14 to selectively rotate in either a clockwise and a counterclockwise direction. In some embodiments, gun sight 10 may include more than one drive mechanism 16 to control rotation of imaging system 14.

Gyroscope 18 may comprise any suitable electronic device configured to measure angles of elevation, tilt, slope or depression of an object with respect to a gravitational vector or horizon. Gyroscope 18 may further be configured to output such measured angles to other components that are coupled with gyroscope 18. Gyroscope 18 may be mounted to imaging system 14 or to weapon 12 and, once mounted, gyroscope 18 will detect the angular orientation of imaging system 14 or gyroscope 18, respectively. As used herein, any reference to measurement of angular orientation by gyroscope 18 refers to the measurement of an elevation angle. The angular orientation detected by gyroscope 18 can be provided to, or retrieved by, processor 20, as discussed below.

Processor 20 may be any type of computer, controller, micro-controller, circuitry, chipset, computer system, or microprocessor that is configured to perform algorithms, to execute software applications, to execute sub-routines and/or to be loaded with and to execute any other type of computer program. Processor 20 may comprise a single processor or a plurality of processors acting in concert.

Processor 20 is communicatively coupled to drive mechanism 16 and gyroscope 18. Such coupling may be accomplished through the use of any suitable means of transmission including both wired and wireless connections. In the illustrated embodiment, processor 20 is directly communicatively coupled to each drive mechanism 16 and gyroscope 18, but it should be understood that in other embodiments, processor 20 may be indirectly coupled with drive mechanism 16 and/or gyroscope 18. For example, such communicative couple may be achieved through the use of a communications bus or via the interposition of intervening components. In still other examples, such coupling may be accomplished through the use of wireless communications such as Bluetooth' communications or through any other suitable short range radio communications without departing from the teachings of the present disclosure.

Being communicatively coupled provides a pathway for the transmission of commands, instructions, interrogations and other signals between processor 20, on the one hand, and drive mechanism 16 and gyroscope 18, on the other hand. Drive mechanism 16 and gyroscope 18 may be configured to interface and engage with processor 20. For example, drive mechanism 16 may be configured to receive commands from processor 20, either directly or indirectly, and may initiate actuation and/or cease actuation in response to such commands. Gyroscope 18 may be configured to provide angular orientation information to processor 20 in response to queries from processor 20 or, alternatively, gyroscope 18 may be configured to continuously or periodically broadcast such information and processor 20 may be configured to receive such information.

Processor 20 is configured to interact with, coordinate, and/or orchestrate the activities of drive mechanism 16 and gyroscope 18 for the purpose of maintaining imaging system 14 at a desired (e.g., initial) angle when weapon 12 is being superelevated. When superelevation is initiated, a signal may be sent to processor 20 indicating such initiation. At that time, processor 20 will obtain from gyroscope 18, information that pertains to the angular orientation of gyroscope 18. If gyroscope 18 is mounted to imaging system 14, then the information obtained from gyroscope 18 will be indicative of an initial angular orientation of imaging system 14 with respect to gravity. If gyroscope 18 is mounted to weapon 12, then the information obtained from gyroscope 18 will be indicative of a current angular orientation of weapon 12 with respect to gravity. Processor 20 will utilize the information provided by gyroscope 18 to determine when and how to actuate drive mechanism 16 in order to maintain imaging system 14 at an angle that permits imaging system 14 to a maintain line of sight with a desired target. Prior to any change in elevation of weapon 12, processor 20 will not issue any commands to drive mechanism 16 and the angular orientation of imaging system 14 will remain unchanged.

When the elevation angle of weapon 12 begins to change during superelevation, processor 20 will receive updated information from gyroscope 18 that is reflective of a change in the angular orientation of either imaging system 14 or weapon 12. Processor 20 will utilize this updated information to provide instructions to drive mechanism 16 to thereby cause drive mechanism 16 to rotate imaging system 14 in a manner that offsets the change in elevation of weapon 12, the goal being to maintain a line of sight between imaging system 14 and the target. Further changes in the elevation angle of weapon 12 will cause further changes in the angular orientation of gyroscope 18, which will be obtained by processor 20 and used to provide further instructions to drive mechanism 16 to adjust the angular orientation of imaging system 14. This process will continue in an iterative manner throughout the period when weapon 12 is being superelevated, causing the angular orientation of imaging system 14 to be repeatedly adjusted in a manner that offsets the rotation of weapon 12. This ensures that imaging system 14 maintains the line of sight to the target. This, in turn, allows the image of the desired target to remain on display 24 throughout the entire period of superelevation of weapon 12.

Figure 2:
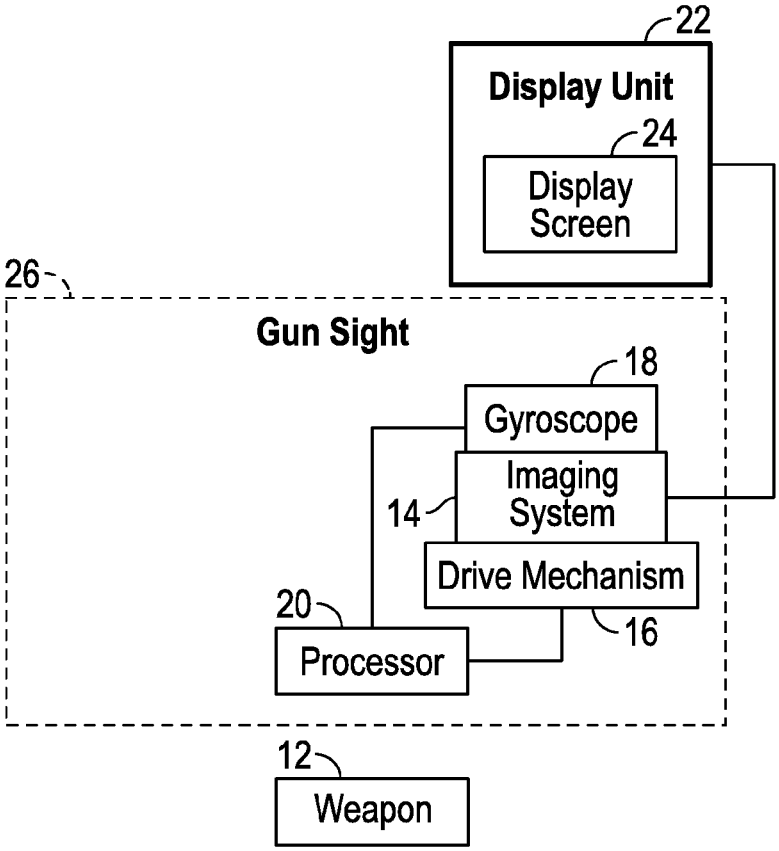
FIG. 2 is a block diagrammatic view illustrating a non-limiting embodiment the gun sight of FIG. 1.

FIG. 2 is a block diagram illustrating another non-limiting embodiment of gun sight 10 of FIG. 1. In gun sight 26, gyroscope 18 is associated with imaging system 14. In some embodiments, gyroscope 18 may be mounted directly to imaging system 14. In other embodiments, gyroscope 18 may be mounted indirectly to imaging system 14. For example, gyroscope 18 may be mounted to a structure that is connected to imaging system 14, one that will rotate together with imaging system 14. Mounted in this manner, gyroscope 18 will be able to detect the angular orientation of imaging system 14.

In gun sight 26, processor 20 is configured to stabilize imaging system 14 during superelevation of weapon 12 by controlling drive mechanism 16 to maintain an initial angular orientation of imaging system 14. Processor 20 may be configured to receive input from an operator or from weapon 12 that contains information that is indicative of the initiation of superelevation of weapon 12. For example, to initiate superelevation of weapon 12, an operator may actuate a switch on weapon 12. This actuation may send a signal to processor 20 indicating that superelevation has commenced.

In response to receiving the information that superelevation has commenced, processor 20 will obtain the current angular orientation of imaging system 14 from gyroscope 18 and store this angle as the initial angular orientation of imaging system 14. Because imaging system 14 is mounted to weapon 12, as weapon 12 is superelevated, the angular orientation of imaging system 14 will begin to change. As the angular orientation of imaging system 14 begins to change, gyroscope 18 will report the new angular orientation of imaging system 14 to processor 20. When processor 20 detects that the new angular orientation of imaging system 14 differs from the initial angular orientation of imaging system 14, processor 20 will send instructions to drive mechanism 16 to rotate imaging system 14 in a manner that counteracts the rotation of weapon 12 and that restores processor 20 to (or maintains processor 20 at) its initial angular orientation. This process of correcting any deviation detected in the angular orientation of imaging system 14 will continue in an iterative manner throughout the period when weapon 12 is being superelevated. Once weapon 12 has reached the desired elevation angle, the operator of weapon 12 or weapon 12 itself or the fire control system associated with weapon 12 will provide a second input to processor 20 indicating that superelevation has been completed. At this point, processor 20 may cease providing instructions to drive mechanism 16 and imaging system 14 will be permitted to, once again, rotate together with weapon 12.

By implementing the above described protocol, any change in angular orientation of imaging system 14 that would have otherwise resulted from the superelevation of weapon 12 is offset by a series of counter-rotations of imaging system 14 or, depending upon calibrations and sensitivities of equipment, by a smooth, continuous counter-rotation of imaging system 14. This counter-rotation allows imaging system 14 to maintain its line of sight to the desired target throughout the period when weapon 12 is being superelevated. So long as imaging system 14 maintains its line of sight to the desired target, the image of the desired target that is captured by imaging system 14 will remain on display 24.

Figure 3:
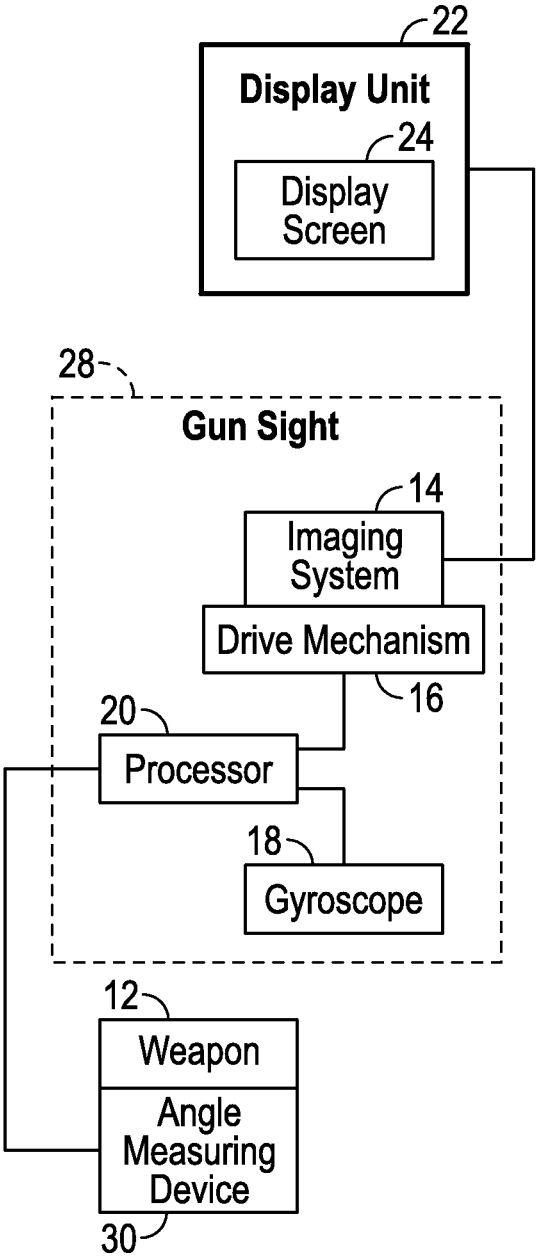
FIG. 3 is a block diagrammatic view illustrating another non-limiting embodiment the gun sight of FIG. 1.

FIG. 3 is a block diagram illustrating another non-limiting embodiment of gun sight 10 of FIG. 1. In gun sight 28, gyroscope 18 is associated with weapon 12. In some embodiments, gyroscope 18 may be mounted directly to weapon 12 while in other embodiments, gyroscope 18 may be indirectly mounted to weapon 12 such as through an intervening structure or other component that is mounted to weapon 12. Mounted in this manner, gyroscope 18 will be able to detect the angular orientation of weapon 12.

In FIG. 3, weapon 12 includes an angle measuring device 30 that is configured to measure changes in the angle between the weapon 12 and imaging system 14. Angle measuring device 30 may be any device suitable for measuring change in angular orientation between two components including, but not limited to, an encoder and a resolver. In some embodiments, a gyroscope may be utilized as angle measuring device 30.

Angle measuring device 30 is configured to report measured changes in angular orientation of weapon 12 relative to gun sight imaging system 14 in elevation axis to a fire control system associated with weapon 12. The fire control system may utilize such measured changes in angular orientation to determine firing solutions and also to control the placement of a reticle on display 24.

Angle measuring device 30 may also configured to measure the angular orientation of the gun sight (gun sight 28) with respect to weapon 12. In other embodiments, weapon 12 may include two angle measuring devices, one to measure the change in angular orientation of weapon 12 and the other to measure the angular orientation of gun sight 28 with respect to weapon 12.

In gun sight 28, processor 20 is configured to receive information from gyroscope 18 indicative of the angular orientation of weapon 12. Processor 20 is further configured to receive information from angle measuring device 30 indicative of the then current angular orientation or change in angular orientation of weapon 12. Processor 20 is further configured to receive input from either an operator or from weapon 12 containing information that is indicative of the initiation of superelevation of weapon 12. For example, to initiate superelevation of weapon 12, the operator may actuate a switch on weapon 12. This actuation may send a signal to processor 20 indicating that superelevation has commenced. At the start of superelevation, imaging system 14 is oriented at an angle that provides a line of sight to the desired target. This angle will be referred to herein as the desired angular orientation of imaging system 14. Processor 20 will maintain imaging system 14 at the desired angular orientation throughout the superelevation of weapon 12.

In response to receiving the information that superelevation has commenced, processor 20 will obtain the current angular orientation of weapon 12 from gyroscope 18 and the change in angular orientation of weapon 12 which, at the outset of superelevation, will be zero. As weapon 12 is superelevated, the angular orientation of weapon 12 will begin to change. The change in angular orientation will be detected by gyroscope 18 and reported to processor 20. Additionally, as weapon 12 is superelevated, angle measuring device 30 will begin to measure or otherwise detect changes in the angular orientation of weapon 12 and will report such changes to processor 20.

Processor 20 is configured to utilize the information provided by gyroscope 18 and by angle measuring device 30 to control drive mechanism 16 in a manner that maintains imaging system 14 at the desired angular orientation. For example, processor 20 will send instructions to drive mechanism 16 that will control drive mechanism 16 to rotate imaging system 14 in a direction and by an amount that offsets the change in angular orientation measured by angle measuring device 30. As weapon 12 continues to superelevate, new angular orientations will repeatedly be detected by gyroscope 18 and new measured changes in elevation will repeatedly be measured by angle measuring device 30. As this new information is received by processor 20, processor 20 will repeatedly send additional commands to drive mechanism 16 that will cause drive mechanism 16 to rotate imaging system 14 in a manner that offsets the changes in angular orientation that would otherwise be brought about by the superelevation of weapon 12. In this iterative manner, imaging system 14 will be maintained at the desired angular orientation during the superelevation of weapon 12.

Once weapon 12 has reached the desired elevation angle, the operator of weapon 12 or weapon 12 itself or the fire control system associated with weapon 12 may provide a second input to processor 20 indicating that superelevation has been completed. At this point, processor 20 will cease providing instructions to drive mechanism 16 that cause drive mechanism 16 to rotate imaging system 14 and imaging system 14 will, once again, be permitted to rotate together with weapon 12 in both azimuth and elevation.

By implementing the above described protocol, any change in angular orientation of imaging system 14 that would have otherwise resulted from the superelevation of weapon 12 may be offset by a series of counter-rotations of imaging system 14 or, depending upon the calibration and sensitivities of equipment, by a smooth, continuous rotation of imaging system 14. These counter-rotations allow imaging system 14 to maintain its line of sight to the desired target throughout the period when weapon 12 is being superelevated. So long as imaging system 14 maintains its line of sight to the desired target, the image of the desired target that is captured by imaging system 14 will remain on display 24.

Figure 4:
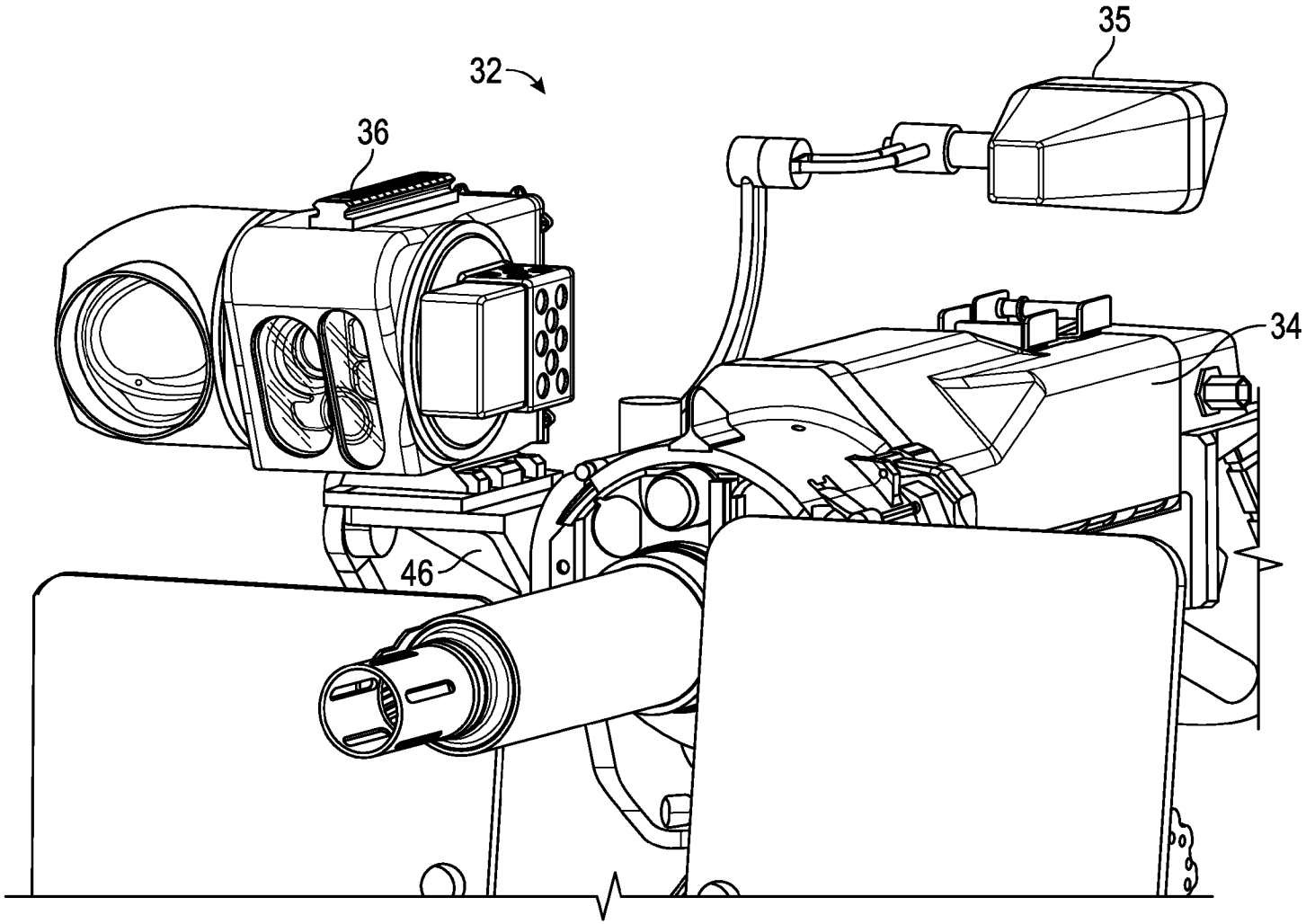
FIG. 4 is a perspective view illustrating a weapon system including the gun sight of FIG. 1.

FIG. 4 is a perspective view of a weapon system 32 including a machine grenade launcher 34 and a gun sight 36. Machine grenade launcher 34 is configured for superelevation and gun sight 36 has been configured to maintain a line of sight with a target as machine grenade launcher 34 is being superelevated. A display unit 35 is illustrated extending from machine grenade launcher 34 and is used by the operator to scan the down field area for targets.

Figure 5:
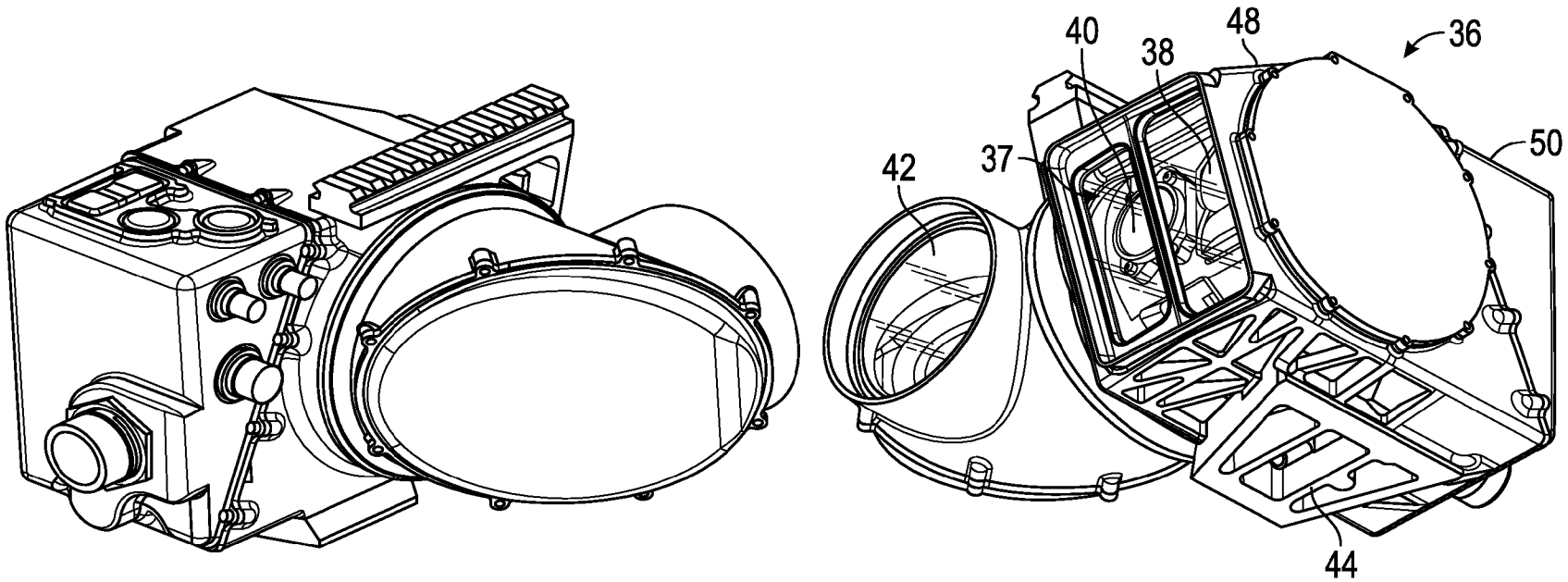
FIG. 5 is an expanded perspective view illustrating the gun sight of FIG. 4.

FIG. 5 is an expanded perspective view of gun sight 36. Gun sight 36 includes an imaging system 37 including three discrete imaging sub-systems; a laser range finder 38, a daylight imaging sub-system 40, and a thermal imaging sub-system 42. With continuing reference to FIG. 4, underside 44 of gun sight 36 is configured to be mounted to machine grenade launcher 34 via mount 46 (see FIG. 4). A housing 48 surrounds imaging system 37 to protect it from the elements. Imaging system 37 is configured to rotate with respect to housing 48 and housing 48 is configured to rotate together with machine grenade launcher 34 when machine grenade launcher is superelevated. Thermal imaging sub-system 42 is physically connected with the remainder of imaging system 37, but extends outside of housing 48. Because of its physical connection to the remainder of imaging system 37, thermal imaging sub-system 42 also rotates with respect to housing 48 during superelevation of machine grenade launcher 34. Circuit card assembly 50 contains various circuit cards and/or controllers and/or processors which may be configured to control the angular orientation of imaging system 37 in the manner discussed above with respect processor 20 of FIGS. 2 and 3.

Figure 6:
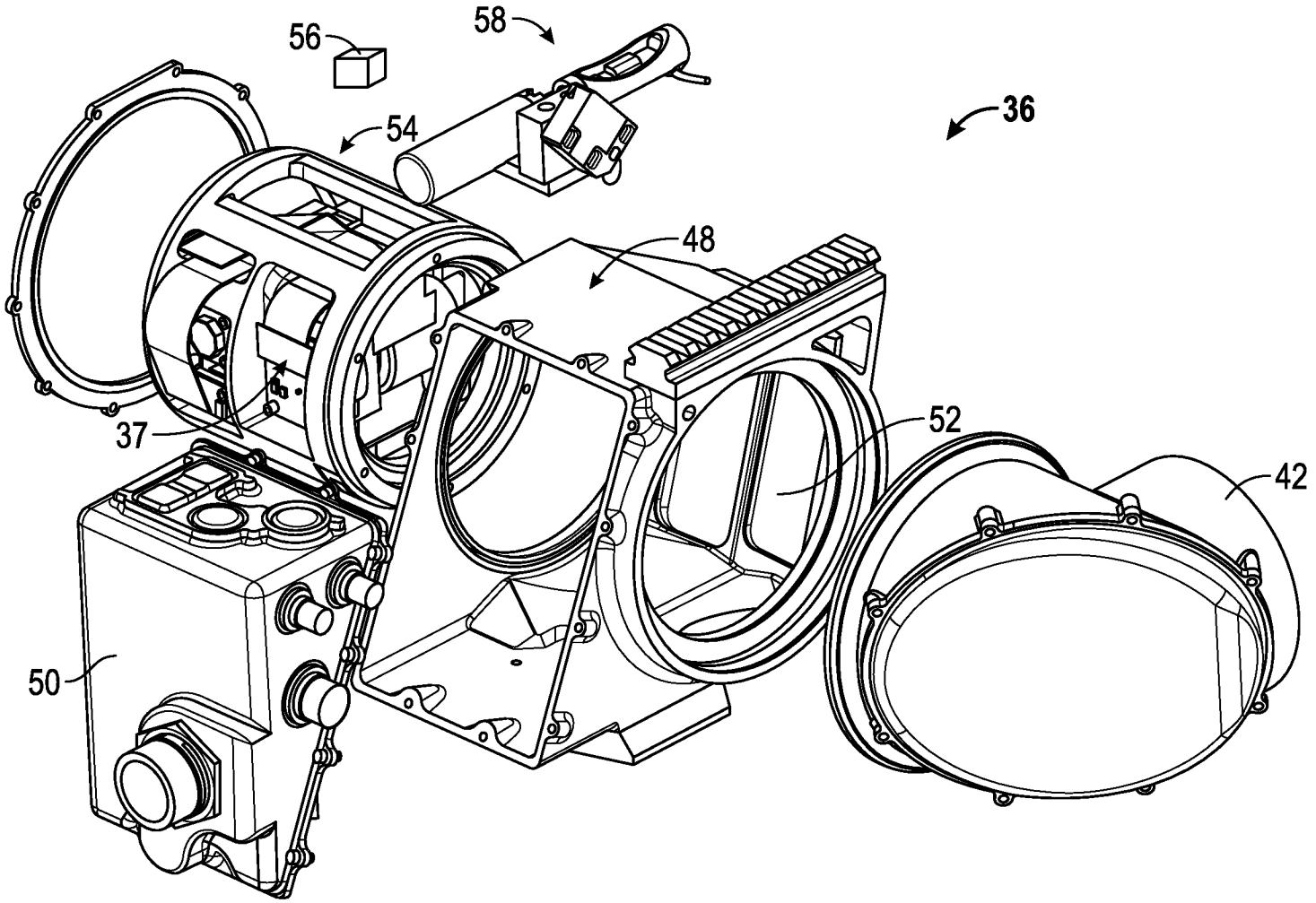
FIG. 6 is an exploded view illustrating the gun sight of FIG. 5.

FIG. 6 is an exploded view of gun sight 36. Housing 48 includes a bore 52 extending laterally through housing 48. Imaging system 37 is mounted within a drum 54. Drum 54 is generally cylindrical in configuration and has a circular cross section. Bore 52 is configured to receive drum 54 and drum 54 is configured to rotate with respect to housing 48 while received within bore 52.

A gyroscope 56 is also illustrated in FIG. 6. Depending upon how circuit card assembly 50 is programmed (i.e., in accordance with the protocol discussed above with respect to either FIG. 2 or FIG. 3), gyroscope 56 may be assembled to drum 54, to imaging system 37, to housing 48, to circuit card assembly 50, or to machine grenade launcher 34. In embodiments where circuit card assembly 50 is programmed to follow the protocol discussed above in conjunction with FIG. 2, then gyroscope 56 would be mounted either to drum 54 or to imaging system 37. In embodiments where circuit card assembly 50 is programmed to follow the protocol discussed above in conjunction with FIG. 3, then gyroscope 56 will be mounted to housing 48, to circuit card assembly 50, or on machine grenade launcher 34.

A drive mechanism 58 is also illustrated in FIG. 6. Drive mechanism 58 is configured to mount to housing 48 and to engage drum 54. When drive mechanism 58 is actuated by circuit card assembly 50, it will cause drum 54 to rotate either clockwise or counter-clockwise, as needed, to maintain imaging system 37 in a steady angular orientation as machine grenade launcher 34 is superelevated.

Figure 7:
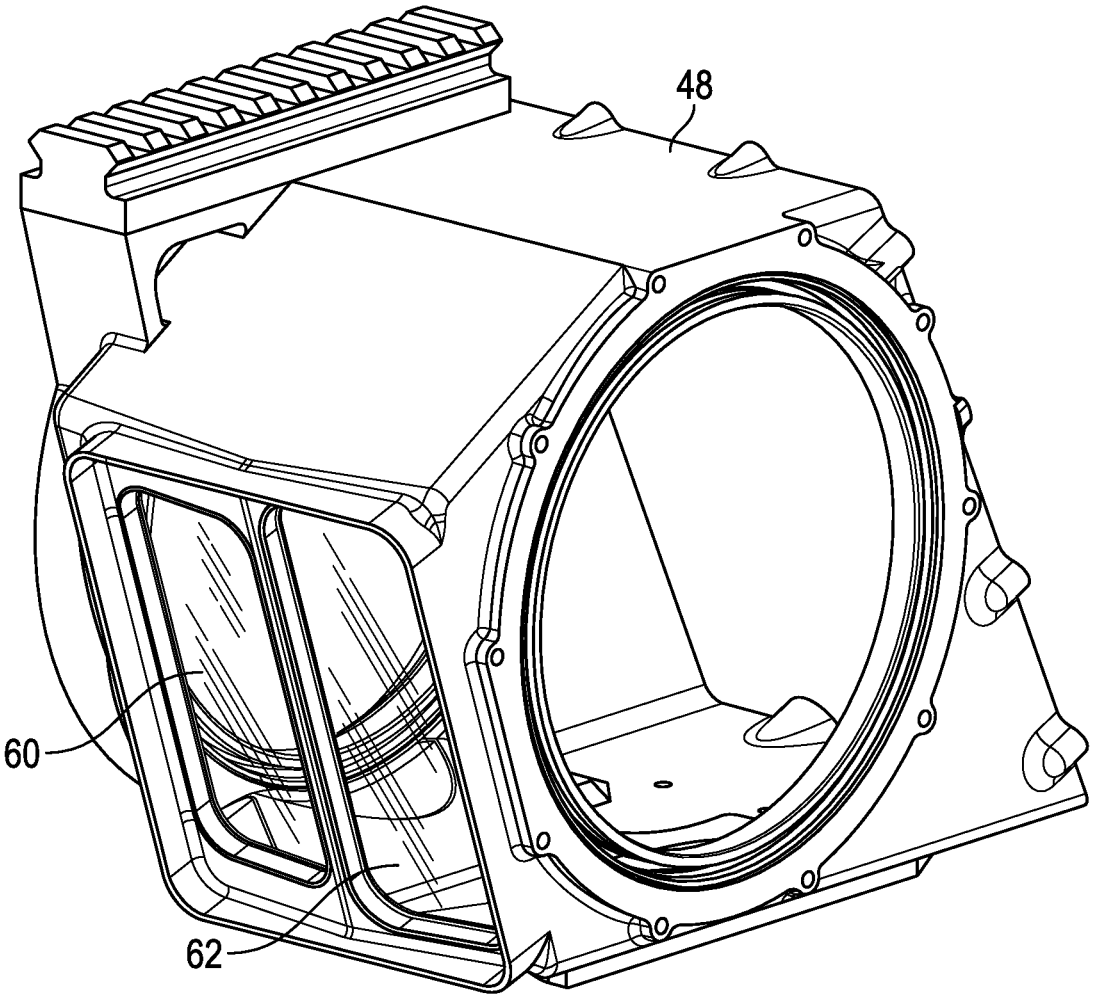
FIG. 7 is an expanded perspective view illustrating a housing for use with the gun sight of FIG. 5.

FIG. 7 is an expanded perspective view of housing 48. Housing 48 includes windows 60 and 62. With continuing reference to FIG. 5, windows 60 and 62 permit laser range finder 38 and daylight imaging sub-system 40 to receive images of the down range area without obstruction, while still permitting the use of dry air or dry nitrogen inside of housing 48 to inhibit fogging of the optical elements comprising imaging system components.

In an embodiment, the gyroscope may be configured to measure, detect, or otherwise determine the angular rate of change of the weapon (e.g., degrees per second) when the weapon is superelevated. The gyroscope is further configured to provide information to the processor indicative of the angular rate of change of the weapon. The processor is configured to utilize the information provided by the gyroscope to determine the change of the angle of the weapon. For example, based on the sampling rate and the angular rate of change, the processor may be configured to determine how many degrees the weapon has elevated. The processor is further configured to provide instructions to the motor based on this determination to counter rotate the gun sight to offset the angular change of the weapon. In some embodiments, the gyroscope may be configured to provide information to the processor only when the weapon is being superelevated.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A gun sight for use with a weapon, the gun sight comprising:

an imaging system configured for rotation in elevation;

a drive mechanism associated with the imaging system and configured to rotate the imaging system;

a gyroscope associated with one of the weapon and the imaging system; and a processor communicatively coupled with the drive mechanism and the gyroscope and configured to control the drive mechanism to rotate the imaging system in a manner that contemporaneously offsets rotation of the weapon to cause the imaging system to maintain an initial angular orientation based, at least in part, on information provided by the gyroscope when the weapon is superelevated.

2. The gun sight of claim 1, wherein the information provided by the gyroscope is indicative of a change in angular orientation of the gyroscope.

3. The gun sight of claim 1, wherein the gyroscope is associated with the imaging system and wherein the processor is configured to control the drive mechanism to rotate the imaging system when the gyroscope detects a change in an angular orientation of the imaging system.

4. The gun sight of claim 1, wherein the gyroscope is associated with the weapon and wherein the processor is configured to control the drive mechanism to rotate the imaging system when the gyroscope detects a change in an angular orientation of the weapon.

5. A gun sight for use with a weapon, the gun sight comprising:

an imaging system adapted to be operatively coupled to a display unit having a display, the imaging system configured to control the display unit to depict an image of a scene that includes a target, the imaging system further configured for rotation in elevation;

a gyroscope associated with the imaging system and configured to detect both an angular orientation of the imaging system and a change in the angular orientation of the imaging system;

a drive mechanism associated with the imaging system and configured to rotate the imaging system; and a processor communicatively coupled with the drive mechanism and the gyroscope, the processor configured to control the drive mechanism to rotate the imaging system in a manner that contemporaneously offsets rotation of the weapon to cause the imaging system to maintain an initial angular orientation based, at least in part, on information provided by the gyroscope when the gyroscope detects the change in the angular orientation of the imaging system during superelevation of the weapon.

6. The gun sight of claim 5, wherein the processor is configured to control the drive mechanism to rotate the imaging system to cause the target to continuously remain stabilized on the display during superelevation of the weapon.

7. The gun sight of claim 5, wherein the processor is configured to obtain the initial angular orientation of the imaging system from the gyroscope when superelevation of the weapon is initiated.

8. The gun sight of claim 5, further comprising a housing, wherein the imaging system is enclosed within the housing, wherein the housing is configured to rotate together with the weapon during superelevation, and wherein the imaging system is configured to rotate with respect to the housing.

9. The gun sight of claim 8, further comprising a drum, wherein the imaging system is mounted to the drum and wherein the drum is rotatably mounted to the housing.

10. The gun sight of claim 9, wherein the drive mechanism is configured to engage the drum and rotate the drum in relation to the housing.

11. The gun sight of claim 5, wherein the imaging system comprises a daylight imaging system and a laser range finder.

12. The gun sight of claim 11, wherein the imaging system further comprises a thermal imaging system.

13. A gun sight for use with a weapon having an angle measuring device configured to measure both an angular orientation of the weapon and a change in the angular orientation of the weapon, the gun sight comprising:

an imaging system adapted to be operatively coupled to a display unit having a display, the imaging system configured to control the display unit to display an image of a scene that includes a target, the imaging system further configured for rotation in elevation;

a gyroscope adapted for mounting to the weapon and configured to detect a current angular orientation of the weapon;

a drive mechanism associated with the imaging system and configured to rotate the imaging system; and a processor communicatively coupled with the drive mechanism and the gyroscope and adapted for communicative coupling with the angle measuring device, the processor configured to obtain the current angular orientation of the weapon during superelevation from the gyroscope and to obtain the change in the angular orientation of the weapon during superelevation from the angle measuring device, the processor further configured to control the drive mechanism to rotate the imaging system in a manner that contemporaneously offsets rotation of the weapon to maintain a desired angular orientation of the imaging system based, at least in part, on information provided by the gyroscope when the gyroscope detects the change in the angular orientation of the weapon while the weapon is superelevated.

14. The gun sight of claim 13, wherein the processor is configured to control the drive mechanism to rotate the imaging system to cause the target to continuously remain stabilized on the display during superelevation of the weapon.

15. The gun sight of claim 13, wherein the processor is configured to calculate the desired angular orientation of the imaging system by subtracting the change in the angular orientation of the weapon from the current angular orientation of the weapon.

16. The gun sight of claim 13, further comprising a housing, wherein the imaging system is enclosed within the housing, wherein the housing is configured to rotate together with the weapon during superelevation, and wherein the imaging system is configured to rotate with respect to the housing.

17. The gun sight of claim 16, further comprising a drum, wherein the imaging system is mounted to the drum and wherein the drum is rotatably mounted to the housing.

18. The gun sight of claim 17, wherein the drive mechanism is configured to engage the drum.

19. The gun sight of claim 13, wherein the imaging system comprises a daylight imaging system and a laser range finder.

20. The gun sight of claim 19, wherein the imaging system further comprises a thermal imaging system.

* * * * *